US005190371A

United States Patent [19]

Gjerulff

[11] Patent Number: 5,190,371

[45] Date of Patent: Mar. 2, 1993

[54] METHOD AND PLANT PRODUCING A BITUMINOUS PAVING MIXTURE

[75] Inventor: Jorgen Gjerulff, Bronderslev, Denmark

[73] Assignee: Pedershaab Maskinfabrik A/S, Denmark

[21] Appl. No.: 640,307

[22] PCT Filed: Jul. 26, 1989

[86] PCT No.: PCT/DK89/00183

§ 371 Date: Mar. 15, 1991

§ 102(e) Date: Mar. 15, 1991

[87] PCT Pub. No.: WO90/01086

PCT Pub. Date: Feb. 8, 1990

[30] Foreign Application Priority Data

Jul. 27, 1988 [DK] Denmark ..... 4208/88

[51] Int. Cl.[5] ..... B28C 1/22

[52] U.S. Cl. ..... 366/25; 432/106; 432/110; 34/136

[58] Field of Search ..... 366/192, 193, 22, 23, 366/24, 25, 7, 58; 34/135, 136, 137; 432/106, 110, 118

[56] References Cited

U.S. PATENT DOCUMENTS

| | | | |
|---|---|---|---|
| Re. 29,496 | 12/1977 | Dydzyk | 366/25 |
| 3,026,627 | 3/1962 | Moklebust | 34/136 |
| 3,469,324 | 9/1969 | Vissers | 34/136 |
| 4,190,370 | 2/1980 | Brock et al. | 366/25 |
| 4,208,131 | 6/1980 | Mendenhall | 366/25 |
| 4,326,809 | 4/1982 | Mendenhall | 366/7 |
| 4,715,720 | 12/1987 | Brock | 366/25 |
| 4,813,784 | 3/1989 | Musil | 366/25 |

*Primary Examiner*—Harvey C. Hornsby

*Assistant Examiner*—Reginald L. Alexander

*Attorney, Agent, or Firm*—Finnegan, Henderson, Farabow, Garrett and Dunner

[57] ABSTRACT

A drying and mixing plant for producing a bituminous paving mixture comprises a drying and mixing drum (10) which is supported by a hydraulic cylinder (16) or other lifting means so that the inclination of the drum axis may be altered. By choosing a suitably small angle of inclination so that the drum inclines downwardly towards its outlet end, the plant may be used for continuous operation, so-called drum-mixing. Aggregates and other components may then be supplied continuously to the inlet end of the drum from silos (18), through a center intake (24) from another source (25) and binder such as bitumen may be supplied through a supply tube (58). Finished paving mixture is continuously discharged from the outlet end of the drum and passed to a product silo (28) via a conveyor (27). Alternatively, if the drum axis is arranged substantially horizontally, it is possible to treat two or more substantially separate material portions of different compositions in the drum (10) at the same time in so-called batch-mixing. By tilting the drum (10) by means of the cylinders (16), the material portions may be transferred from one drum section to the next after a certain time of treatment, and finished paving mixture may be discharged as a total portion from the drum section adjacent to the outlet end of the drum. The discharged mixture portion may possibly be further treated or be mixed with further materials in a mixing apparatus (30), to which the mixture portion is passed by means of a conveyor (29). The same plant may thus optionally be used for continuous production of large amounts of a paving mixture of the same composition or for batch-wise production of small asphalt amounts of the different compositions.

7 Claims, 3 Drawing Sheets

METHOD AND PLANT PRODUCING A BITUMINOUS PAVING MIXTURE

Figure 1:
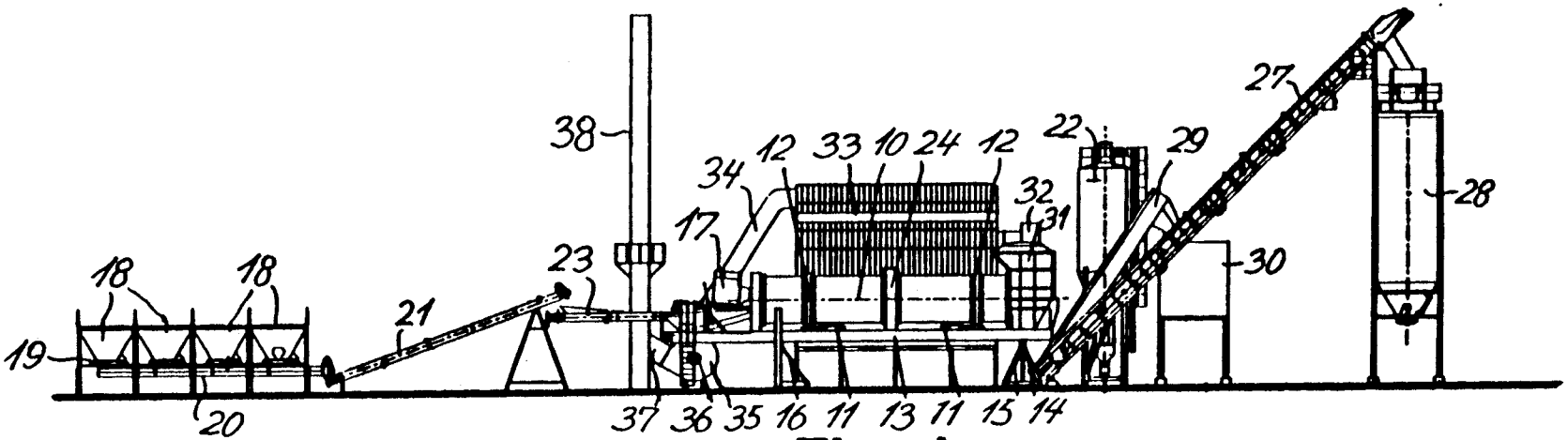

The present invention relates to a method of producing a bituminous or asphalt paving mixture.

So far, practically all bituminous paving mixture has been produced by either one of two different methods, namely the so-called "batch-mixing" and the so-called "drum-mixing", respectively. Batch-mixing is a discontinuous method of production which is suitable for use in connection with production plants from which relatively small amounts of a bituminous or asphalt mixture of varying, further specified compositions are to be delivered during a day to many different purchasers. In the known batch-mixing, stone and sand fractions are metered according to the purchaser's recipe or specifications by means of metering apparatus, and the materials so metered are transported to a drying drum where the materials are dried and heated to a temperature of about 160°-180° C. Then the materials are sieved into 4-6 fractions and stored in a hot silo or buffer silo. From the hot silos a portion or batch of 2000-4000 kg is weighed out, and filler, bitumen and other additives are weighed out as a certain percentage of the stone and sand material according to the recipe presented. When all components have been weighed out, the materials are mixed for about 30-50 seconds in a special mixing apparatus. The mixture is now ready for use and may be transported to a product silo where it may be collected by the purchaser.

Drum-mixing is a continuous method of production which is suitable for use in connection with production plants from which large amounts of bituminous or asphalt paving mixtures of rather uniform compositions are to be supplied, for example in connection with large civil engineering projects or for purchasers of large asphalt mixture amounts. In drum-mixing, aggregate, such as stone and sand fractions are metered continuously in accordance with a recipe or specifications by means of metering apparatus, and the metered materials are continuously passed to a drying drum through which they may flow substantially continuously. In the first part of this drum the materials are dried and heated to a temperature of 160°-180°, and in the last part of the drum, filler, bitumen and any additives are continuously added. The dried and heated materials are mixed with the additives in the last part of the drum so that finished mixture is discharged continuously from the outlet end of the drum.

It will be understood that the known production plants for paving mixtures are rather inflexible, as a certain plant only permits either production of relatively small amounts of mixtures of various compositions or continuous production of a large amount of a paving mixture of the same composition. Therefore, a paving mixture manufacturer who wants to be able to produce large as well as smaller amounts of paving mixtures of a desired compositions has to invest in at least two different plants for batch-mixing and drum-mixing, respectively.

The invention provides a method which renders it possible to produce large amounts as well as relatively small amounts of paving mixture of different compositions in a rational manner in the same plant.

The method according to the invention comprises supplying aggregate, for example sand and/or gravel, into a first section of a rotating drying and mixing drum at an inlet end thereof, introducing at least one further component, for example using paving material, a binder, such as bitumen and/or recycled material into a second section of the drum between said inlet end and an opposite outlet end of the drum, mixing said component with the dried aggregate in the drum, and discharging the mixture at the other end of the drum, and the method according to the invention is characterized in supplying the aggregate to the drum in portions, drying each portion in said first drum section, transferring a first portion to the second drum section after drying such portion and prior to supplying a second portion of aggregate into the drum, and mixing the dried first portion of aggregate with said further component in said second drum section, while said first and second portions are kept substantially apart in the drum.

When two or more portions of aggregate are thus heated simultaneously in one and the same drum and kept substantially separated therein, and the finished mixture is likewise discharged in portions from the outlet end of the drum, this is a case of batchmixing. However, if aggregate and the further component, such as binder and/or other additives, are supplied continuously to the same drum it may be operated as in conventional drum-mixing. The method according to the invention thus renders possible the use of one and the same plant according to both said known mixing principles.

It is possible to treat more than two aggregate portions in the drum at the same time. Thus, a plurality of separate aggregate portions may be treated in various sections of the drum.

These drum sections are normally longitudinal sections of one and the same drum, but, alternatively, the drum may be formed as a drum unit composed by separate drum sections connected in series.

The dried aggregate portions may be transferred from one section to the other in any suitable manner. The aggregate portions may, for example, be pushed from one section to the other by means of some kind of automatically operating pushing means arranged inside the drum. However, the transfer of the dried aggregate portions from one section to another section and possibly also discharging the bituminous mixture from the drum is preferably effected by tilting the drum and/or by increasing the rotational speed of the drum. The tilting may, for example, be effected by supporting one end of the drum by lifting means, for example mechanical jacks or hydraulic or pneumatic cylinders which are adapted to selectively lift or lower one end of the drum.

During the drying and mixing process in the drum the drum axis may be horizontal or may define a small acute angle with a horizontal plane in an upward or downward direction, and when a dried aggregate portion is to be displaced from one drum section to another, this may be effected by lifting one end of the drum so that the aggregate portion may slide forward to the next drum section, while a finished mixture portion may possibly simultaneously be discharged from the drum. Between adjacent drum sections, barriers may be arranged to ensure that the portions being treated simultaneously in the drum are kept apart. These barriers may, for example, be in the form of projections or ribs formed on the inner wall of the drum. These projections may, for example, form an annular, radially inwardly extending partition wall which may be opened when a portion is to be transferred from one drum section to another. Such a partition wall may, for example, be formed by a number of ring sectors which are mounted in the drum wall in such a manner that they may be rotated about substantially radial axes. When a material portion is to be transferred, these rings sectors may be rotated from a position in which they are at substantially right angles to the drum axis into a position in which they extend substantially parallelly therewith. Furthermore, an end wall may be arranged at the outlet end of the drum. Such an end wall may be moved into an open position in case of drum-mixing, or when a portion of finished mixture is to be discharged from the drum in case of batch-mixing.

The invention also relates to a drying and mixing plant for the production of a bituminous paving mixture, said plant comprising a drying and mixing drum having inlet and outlet ends, driving means for rotating the drum about its longitudinal axis, means for feeding aggregate into the drum at its inlet end, and means for supplying a further component, such as a binder, into the drum at locations intermediate of the inlet and outlet ends, and the plant according to the invention is characterized in inclination adjustment means for lifting and lowering the drum so as to change the inclination of the drum axis, and in closure means for selectively at least partly closing and opening the outlet end of the drum. Such a drum which is suitable for drum-mixing may then also be used for batch-mixing, as the aggregate may be introduced into the drum in portions which may then be transferred from one drum section to another or be poured out of the drum by tilting the drum by means of the inclination adjustment means, when the closure means are open. The inclination adjustment means may, for example, be in the form of mechanical jacks or pneumatic or hydraulic cylinders. The transfer and the pouring out of the portions of material may be speeded up by increasing the rotational speed of the drum and thus the material transportation velocity.

The end closure means may, for example, comprise an end wall which is operated by means of hydraulic or pneumatic cylinders, screw spindles or other mechanical moving means. Such end wall may be movable between a closed position in which the end wall is closely adjacent to and at least partly closes the outlet end of the drum, and an open position in which the end wall is spaced from the outlet end so that the latter is open. In batch-mixing the outlet end of the drum is normally kept closed by means of the movable end wall and is opened only when a portion of finished mixture is to be discharged from the drum. In case of drum-mixing, however, the end wall is constantly kept in its open position. However, if the closure means or end wall in its closed position closes the drum end only partly, the closure means may remain closed even in case of drum-mixing.

The aggregate introduced into the drying and mixing drum may, in principle, be dried by supply of heat from heating means of any type or from any suitable heat source. However, in a preferred embodiment, these heating means comprise at least one burner directed into the drum. If the burner is adjusted so that an optimum heat economy is obtained in drum-mixing and at a certain continuous flow of material, it will not be possible to obtain such an optimum heat economy for all sizes of portions of raw material supplied to the drum when the same drum is used for a batch-mixing process. According to the invention the burner may be mounted in such a manner that its direction may be altered, for example in the horizontal as well as in the vertical direction, and the direction of the burner may then be adjusted so that the best possible heat exploitation is obtained at each individual portion size. The position of the burner inside the drum may also optionally be changed, and the burner capacity may likewise be adjusted as desired.

The drum may be divided into sections by at least one annular partition wall extending radially inwardly from the inner wall of the drum, said partition wall being selectively movable between a position in which flow of material between adjacent drum sections is obstructed and a position in which material may flow freely from one section to another. When the drum is used for batch-mixing, the partition wall is normally in its closed position and then serves to divide the drum into sections and to keep apart the individual material portions being simultaneously treated in the drum. However, the partition wall may be opened when the material portions are to be transferred from one drum section to the subsequent one. When the drum is used for drum-mixing, the partition wall may be kept constantly open. The annular partition wall may be divided into ring sectors of which at least some are movable between an obstructing position in which they extend transversely to the drum axis, and a non-obstructing position in which they extend substantially parallelly with or define an acute angle with the drum axis. These ring sectors may, for example, be swingable about radial axes from a position in which they are at substantially right angles to the axis of the drum, into a position in which they extend substantially parallelly with or form an acute angle with the drum axis.

On the drum at one or more locations between its ends there may be one or more material intakes through which material may be introduced in a manner known per se into drum sections positioned between the ends of the drum. Through such intakes, which may, for example, be in the form of material supply tubes or pipes which extend into the drum through one of the ends of the drum in the longitudinal direction thereof and end inside the drum, materials, such as bitumen or another binder, additives and the like, may be introduced into the drum. Through other intakes, recycled material may be supplied, for example in the form of old crushed asphalt pavement, and/or lime and so-called filler, which may, among other things, serve to increase the binding between bitumen and the sand or stone materials, may be introduced. The means for feeding in such further components may in a known manner comprise a peripherally extending baffle wall projecting radially inward from the inner wall of the drum and defining an introduction chamber opening towards the outlet end of the drum. Such an annular introduction chamber will cause a certain amount of material to be retained in the drum upstream of this annular chamber. In drum-mixing this makes no great difference, as large amounts of material of the same composition are treated continuously. However, in batch-mixing, such a retained amount of material from a previously treated material portion will be able to "contaminate" a new material portion of another composition. In order to reduce the amount of material retained by the baffle wall or the introduction chamber, the baffle wall may be divided into sectors so as to define peripheral gaps between adjacent sectors. These baffle wall sectors preferably extend in a direction defining an acute angle with the longitudinal direction of the drum, whereby the baffle wall sectors may impart a movement to the introduced material in a longitudinal direction towards the outlet end of the drum.

In drum-mixing the bituminous paving mixture is normally finished in the mixing drum, and the finished material leaving the drum may therefore be passed directly to, for example, a silo for finished product. When the same drum is used for batch-mixing, it may be desired to subject the mixture portions leaving the mixing drum to a further mixing process. Therefore, the outlet end of the drum may be connected to a mixing apparatus by means of a conveyor. This conveyor which may, for example, be a bucket conveyor, may be provided with weighing cells so that the amount of material supplied to the mixing apparatus may be accurately determined. In addition to the dried and mixed materials arriving from the mixing drum, the mixing apparatus may, for example, be supplied with binders, such as bitumen, filler, chemical additives, colouring agents, etc. Also the mass of these substances is determined accurately so that the desired composition of the finished product may be obtained. The materials to be mixed together, should preferably not stay in the mixing apparatus longer than at all necessary. On the other hand it is of importance that the mixed material becomes homogeneous. The problem may be solved by incorporating measuring probes adapted to determine the percentage content of one of the components at various locations in the mixing chamber of the mixing appartus. When all the measuring probes register substantially the same content of the component in question, the mixing process may be interrupted.

The mixing time may be determined empirically from a given amount of material and on the basis of a certain composition of materials. When the mixing process has been finished, the finished mixture may be discharged directly into a silo for finished product or into a buffer silo from which the material may be passed to a silo for finished product or collected directly by the consumer. Even though it is possible in batch-mixing to treat two or more material portions in different drum sections simultaneously, it is, of course, also possible only to treat a single material portion at a time in the drum.

The plant according to the invention preferably comprises an electronic control device, for example in the form of a microcomputer, for controlling one or more of the following: The inclination of the drum axis, the rotational speed of the drum, the rotational direction of the drum, the position of the end closure means, the position of the partition wall, the adjustment of the burner, the direction of the burner, the composition and temperature of the paving mixture produced, opening and closing of the end closure means and of the partition wall.

The memory of the computer may, for example, contain a large number of recipes for paving mixtures or asphalt compositions. The computer may be adapted to choose the optimum production method (drum-mixing or batch-mixing), when the asphalt recipe and the amount of asphalt to be produced have been entered. The computer may then be adapted to adjust various process parameters, including the angle of inclination of the drum axis, the rotational speed and the direction of revolution of the drying drum, the direction and adjustment in general of the burner, the supply of bitumen, filler, additives, etc., and the temperature of the flue gas. The computer may further be adapted to automatically control the various silos containing the aggregate or raw materials used, such as gravel and sand, and recycling materials, if any. Also the weighing out or metering of these materials may be carried out by the computer, including automatic taring of scales with an alarm for exceeding tare limits, automatic afterflow correction for each metering gate or metering valve, an alarm for exceeding the afterflow limit, monitoring the correct functioning of all end stops, valves and gates, etc., and an alarm in case of malfunction.

The flow speed of the various components which are added to the drum is not the same. However, in order to ensure that all parts of the mixture being produced have the desired composition it is important that all of the components are added with such a timing that they all arrive at the final mixing zone of the drum at the same time. Therefore, the computer is preferably adapted to control the addition of the various components and the various fractions of the aggregate that all of the fractions and components arrive at the final mixing zone at the same time, whereby it may be obtained that also the first and the last part of a large mixture portion produced by drum mixing is of the right composition. Such timing may be made on the basis of empirical values. Because the flow rate of aggregate may depend on the moisture condition thereof, the computer may also control the heating efficiency of the burner so as to obtain a substantially uniform moisture content of the aggregate.

The control of the temperature of the finished mixture may be based on measurements of the temperature of the combustion gas exhausted from the drum. The burner may be adjusted by adjusting the direction of the burner, controlling the amount of fuel supplied to the burner, and by controlling the surplus of air supplied to the burner based on a measurement of $O_2$ or CO in the combustion gas.

Figure 2:
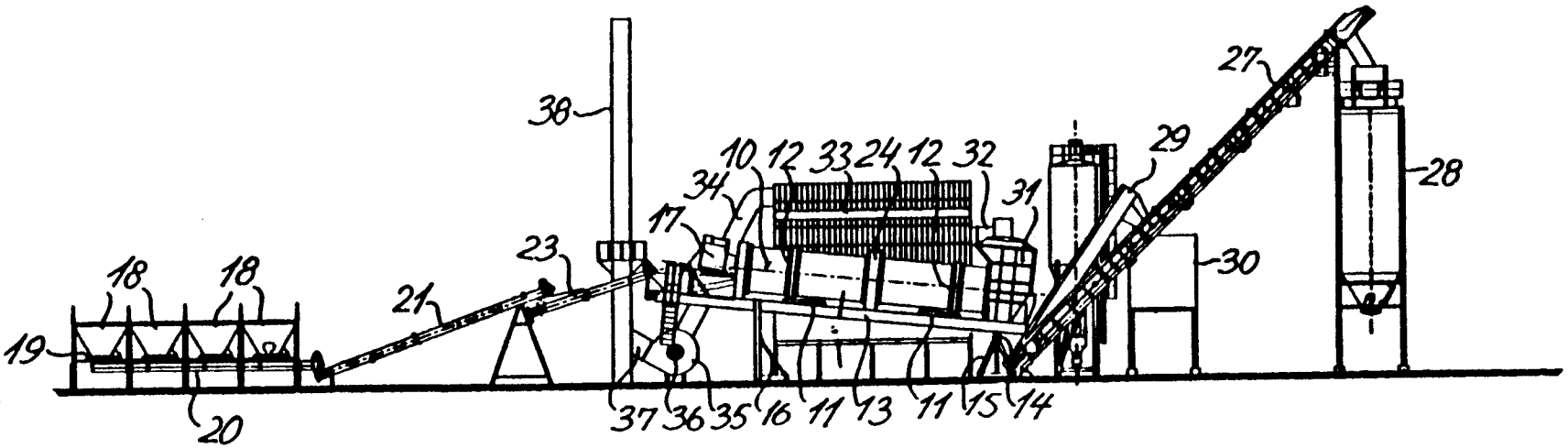
Figure 3:
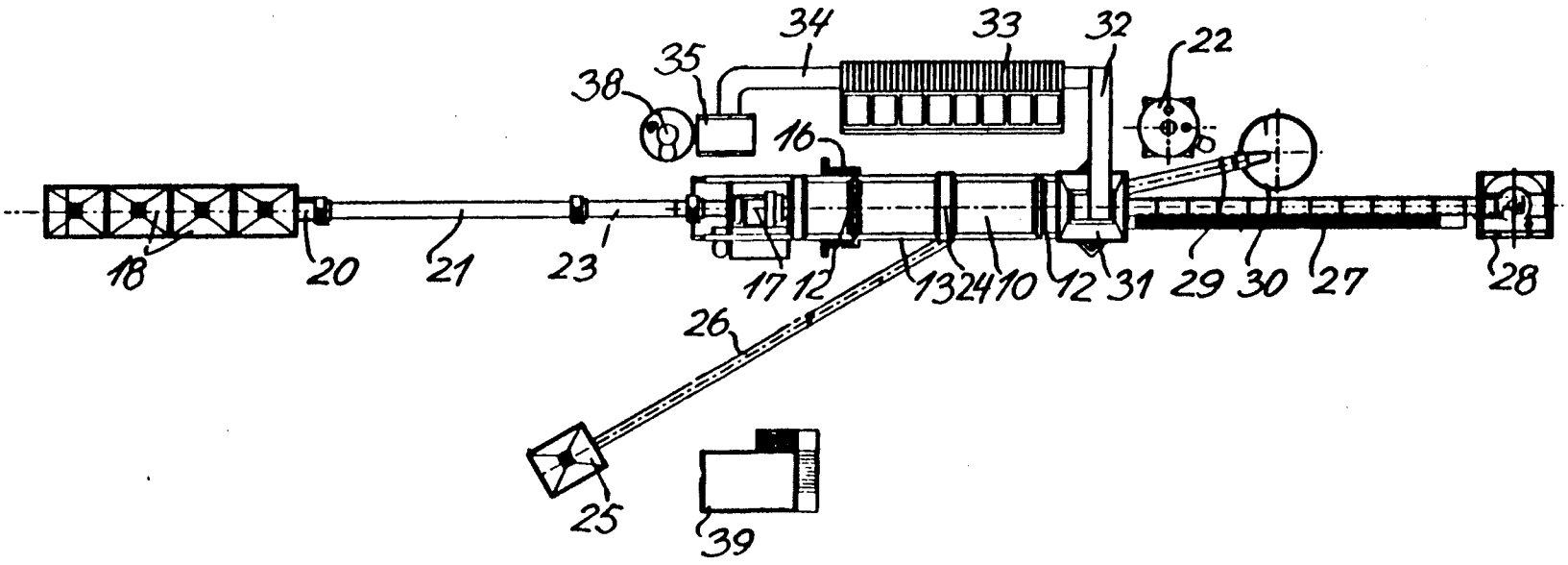
Figure 4:
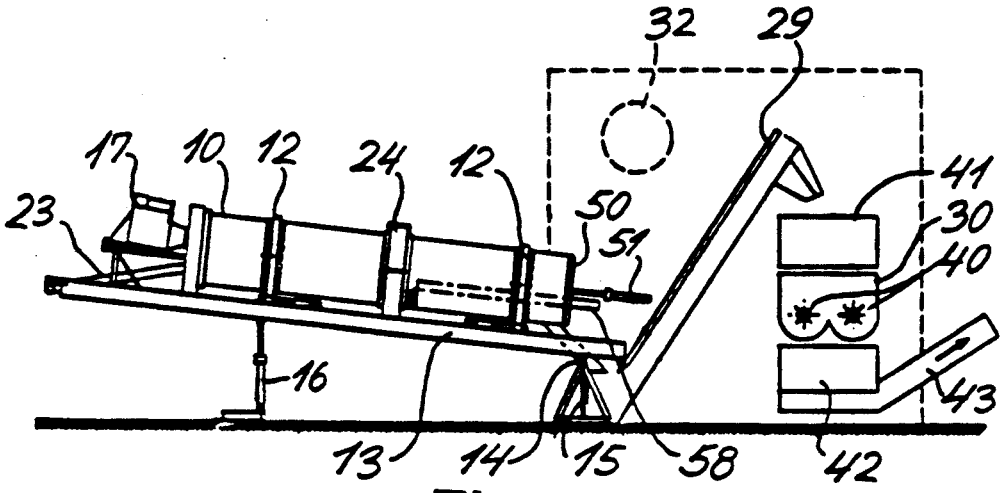
Figure 5:
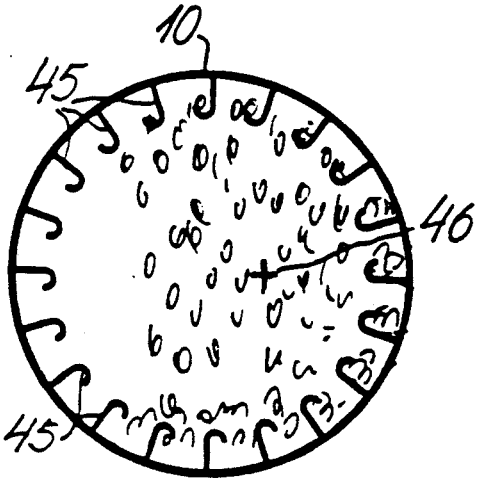
Figure 6:
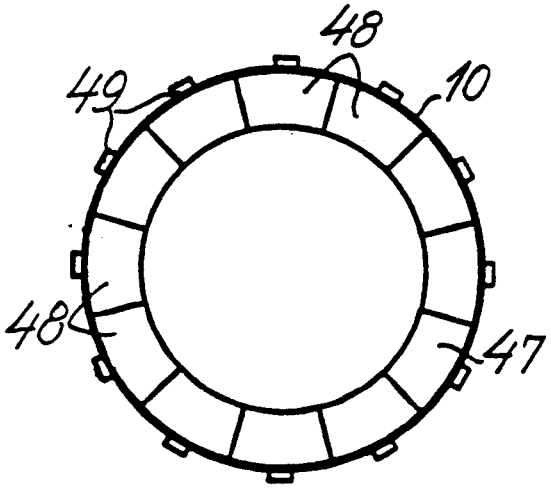
Figure 7:
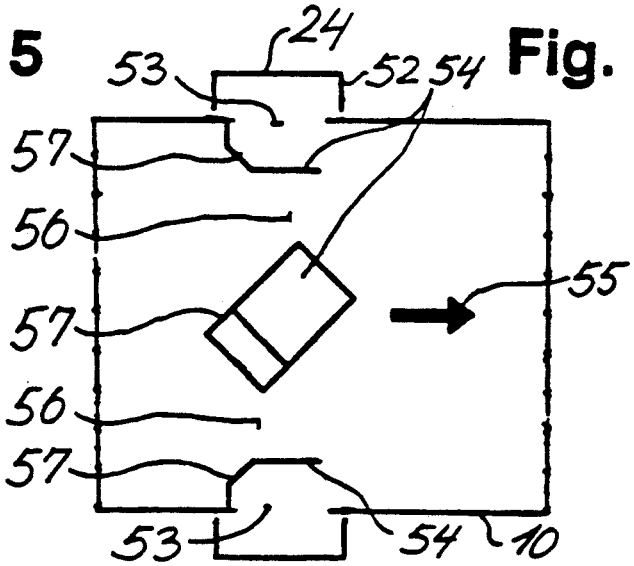

The invention will now be explained more in detail with reference to the drawings, in which FIG. 1 shows a side view of an embodiment of a production plant according to the invention, FIG. 2 shows the same as FIG. 1, where the inlet end of the mixing and drying drum has been elevated, FIG. 3 is a top plan view of the plant shown in FIGS. 1 and 2, FIG. 4 is a diagrammatic, partially sectional side view of a part of the plant, FIGS. 5 and 6 are cross-sections of various parts of the mixing and drying drum of the plant, and FIG. 7 diagrammatically shows part of a longitudinal section of the mixing and drying drum in a material or component intake.

The production plant shown in the drawings comprises a drying and mixing drum 10, which is so mounted that it may be rotated about its longitudinal axis by means of driving motors 11, which, possibly via a gear, drive a friction roll engaging with friction rings 12 arranged on the outer peripheral surface of the drum. The drum 10 is rotatably mounted on a supporting frame 13 having one end connected to a stationary support 15 via a hinge connection 14. The other end of the supporting frame 13 may be lifted or lowered by means of one or more hydraulic cylinders 16 or mechanical lifting means, the frame 13 then being rotated about its hinge connection 14, so that the direction or inclination of the longitudinal axis of the drum 10 may be changed. A burner 17 is arranged at the inlet end of the drum 10. The burner 17 is directed into the drum and is so mounted in relation to the drum that the direction of the burner may be changed in the horizontal as well as in the vertical direction in relation to the drum axis by means of suitable moving means, not shown. Further, the fuel flow fed to the burner and the ratio between the amounts of fuel and combustion air may be adjusted to adjust the heating effect.

A number of aggregate or raw material silos 18 contains a number of fractions, respectively, of sand and gravel material of well-defined grain sizes. According to a given recipe, certain amounts of material or aggregate may be metered from the individual silos by means of metering devices 19, which may, for example, comprise discharge bands, the speed of which may be controlled, weighing cells, etc. These amounts of material or aggregate fall onto an underlying conveyor belt 20 from which they are passed to a longitudinally extending conveyor 21 extending from the outlet end of the conveyor belt to a further conveyor 23 arranged on a higher level. The sand and gravel material, the composition of which with regard to grain size and other properties corresponds to the recipe, is now passed into the inlet end of the drying and mixing drum 10 by means of the conveyor 23. Between its ends the drum 10 comprises a material intake 24, by means of which one or more further materials or aggregate, for example recycled material in the form of old, broken asphalt pavement, filler, chemical additives, etc., may be introduced at a desired location of the drum. Two or more such material intakes may be provided in the drum, if desired. The material(s) supplied to the intake 24 may be metered from a silo 25 and from the latter be passed to the intake 24 by means of a conveyor 26, vide FIG. 3. The design of the intake 24 will be described in further detail below with reference to FIG. 7. Binders, such as bitumen and/or other liquid additives and any solid additives, such as fluxing agents, filler (filter dust, lime, etc.) and other additives which are mixed into the liquid additives, may be introduced into the drum 10 via a supply tube or pipe 58 (vide FIG. 4). One end of the pipe 58 is connected to a binder source, for example via a metering pump, not shown, and the other end of the pipe extends through one of the end openings of the drum 10 into and along the drum so that the supply pipe 58 opens into a section of the drum 10 where it is desired to introduce the binders and/or the additives. It is understood that solid additives may be blown into or pushed into the drum 10 through a similar supply pipe. Thus, for example filler material may be supplied into the drum 10 from a filler silo 22 through one of the supply tubes 58. The supply pipe(s) 58 may be arranged so as to be longitudinally displaceable in relation to the drum so that the position in the drum where the additives are discharged, may be changed, for example depending on whether the drum is used for drum-mixing or batch-mixing. The mixed product or the mixed asphalt leaving the outlet end of the drum 10 may optionally be passed either to a conveyor 27 or to a conveyor 29. The conveyor 27 which may, for example, be a drag chain conveyor, passes the mixture to a silo 28 for finished product, while the conveyor 29, which may, for example be a bucket conveyor, passes the mixture to a mixing apparatus 30.

The outlet end of the drum 10 opens into a chamber 31 the top of which is connected to an air suction duct 32 communicating with a filter aggregate 33 which serves to filter off dust and other small solid particles from the air and the combustion gases flowing through the drum 10. An air duct 34 connects the filter aggregate 33 to a suction fan 35 which is driven by an electric motor 36, and whose air outlet 37 is connected to a chimney 38. As will be explained in detail below, the operation of the plant and the various functions of the individual components may to a large extent be controlled by an electronic control device, such as a microcomputer 39.

As it appears from FIG. 4, a buffer container or silo 41, which may be provided with weighing cells, may be arranged above the mixing apparatus 30 provided with mixing rotors 40. The inlet 42 of a conveyor 43 which may lead to finished product silos, not shown, is arranged immediately below the mixing apparatus 30. As shown in FIG. 4, the conveyor 29, the buffer container 41, the mixing apparatus 30, the conveyor inlet 42 and the outlet end of the drum 10 may be arranged in a closed housing 44 which may possibly replace the chamber 31. In such a case, the housing is connected to the air suction duct 32.

On the inner side of the drum 10 longitudinally extending vanes 45 may be arranged along at least certain drum sections as shown in FIG. 5. These vanes which may, for example, have an angular or J-shaped cross-section as shown, but which may have any other suitable form, serve to a certain extent to carry along some of the material being treated in the drum during the rotation of the drum 10. As indicated in FIG. 5, the material carried by the vanes 45 will fall down from the vanes when they have been moved to an upper position, and the falling material will thus cover a smaller or larger part of the inner drum cross-section. The vanes 45 may extend along a helical or rectilinear path, and the vanes may possibly be longitudinally offset in relation to each other. To obtain good exploitation of the heat being produced by the burner 17, the burner is preferably adjusted during the operation of the plant in such a manner that it is constantly directed approximately towards the centre 46 of the part of the drum cross-section which is covered by the falling material.

Because the production plant described above and shown in the drawings should not only be used for drum-mixing, but also for batch-mixing, the drum 10 should be able to treat two or more axially separated material portions simultaneously in respective drum sections. To ensure good separation of the individual material portions, an annular partition wall 47 like the one shown in FIG. 6 may be arranged on the inner wall of the drum between adjacent drum sections. This partition wall is divided into a plurality of ring sectors 48, and each of these ring sectors is rotatable about a radially directed shaft or pivot pin 49. The ends of these shafts projecting from the outer side surface of the drum, may be interconnected, for example by means of gears, chains or other connecting means, so that they may all be moved by rotating one of the shafts from a rotational position shown in FIG. 6 in which the partition wall 47 is closed and all of the ring sectors 48 extend at substantially right angles to the drum axis, and into another rotational position in which the partition wall is open and all of the ring sectors extend substantially parallel to the drum axis or form an acute angle therewith. The ring sectors 48 may then be moved from their closed position to their open position when a material portion is to be transferred from one drum section to another as will be explained in detail below. Similarly, as indicated in FIG. 4, an end wall 50 may be arranged at the outlet end of the drum 10, which end wall is preferably annular and which may be moved by means of a hydraulic cylinder 51 or similar moving means between a closed position in which the end wall is adjacent to the outlet end of the drum 10, and an open position in which the outlet end of the drum is open.

As shown in FIG. 7, the material intake 24 indicated in FIGS. 1–4 is a stationary annular material introduction chamber 52 into which material is introduced from the silo 25 by means of the conveyor 26. This material may fall into the drum 10 from the chamber 52 through an annular row of mutually spaced openings 53 which are formed in the drum wall. An obliquely extending baffle plate or bucket 54 projecting into the inner space of the drum is aligned with each of the openings 53 and is shaped so as to move the material in a direction indicated by an arrow 55 towards the outlet end of the drum 10. Because of the free spaces 56 between the individual baffle plates or buckets 54, and because each of the baffle plates or buckets 54 is provided with a sloping surface 57, material being treated in the drum 10 may almost freely pass in an axial direction past the baffle plates or buckets 54 without any substantial amounts of material being retained by the baffle plates.

The production plant shown in the drawings and described above operates in the following manner:

If a large amount of bituminous paving mixture or asphalt mixture of a uniform composition is to be prepared, it is advantageous to use the drum-mixing principle. This means that sand and stone materials from the silos 18 are continuously supplied to the inlet end of the drum 10 in the ratios corresponding to those in the asphalt recipe. The drum 10 is rotated at a suitable rotational speed by means of the driving motors 11, and the direction of the burner 17 is adjusted in such a manner that an optimum heating effect is obtained at the resulting material flow rate. Further, the air and fuel supply to the burner is controlled in such a manner in relation to the material flow that the stone and sand material flowing through the drum 19 is heated and dried to the desired extent. Bitumen, filler, recycled material in the form of used, broken asphalt pavement, additives, etc., are continuously passed into the drum through the material intake 24 and the supply tube or tubes 58 and through any other corresponding material inlets. The finished hot asphalt mixture leaves the drum 10 continuously through its outlet end and is passed to the finished product silo 28 via the drag chain conveyor 27. When drum-mixing is used, any internal partition walls 47 in the drum may be constantly in their open position, and the end wall 50 of the drum may be constantly in its open position so that the materials passed into the drum 10 may fairly freely move along through the drum, and the finished asphalt mixture may likewise flow out freely from the outlet end of the drum.

If the production plant is to be used for the production of small amounts of asphalt mixture (for example 2000–4000 kg) according to the same recipe, the plant is advantageously operated according to the batch-mixing principle. Metered amounts of sand and stone material in the ratio prescribed by the recipe is metered from the silos 18 and then passed into the drum 10 by means of the conveyors 21 and 23. This material portion is introduced into the first drum section, which is adjacent to the inlet end of the drum 10. The drum 10 is now rotated at a suitable rotational speed, and the direction of the burner 17 is adjusted in dependency of the pattern formed by the falling material across the drum cross-section (vide FIG. 5) so that an optimum exploitation of the heat energy developed by the burner is obtained. The amounts of air and fuel supplied to the burner are adjusted in order to obtain a desired degree of drying of the sand and stone materials treated. In case of drum-mixing, the drum 10 is preferably given a constant small inclination downward in the direction of the outlet end during the whole process. However, in case of batch-mixing, the hydraulic cylinders 16 are preferably adjusted so that the drum axis is substantially horizontal. This causes all the amount of material being treated in the first drum section to remain therein. As explained above, the drum sections may be separated by means of an annular partition wall 47 as the one shown in FIG. 6. During operation of the drum this partition wall will be in its closed position, and the end wall 50 of the drum will also be closed. When the desired temperature or degree of dryness of the material portion present in the first drum section have been obtained, the inlet end of the drum 10 is lifted by means of the cylinders 16 so that the drum will incline towards the outlet end. At the same time the annular partition wall 47 is opened. This causes the heated and dried material portion to slide from the first drum section into the second drum section. The partition wall 47 is now closed again, and a new portion of sand and stone material of a new composition may be introduced into the first drum section from the silos 18. The hydraulic cylinders 16 may now be operated so as to bring the drum 10 back into its substantially horizontal position. While the drying process just described above is repeated for the new material portion which has been introduced into the first drum section, metered material portions to be mixed with the dry and heated sand and stone material in the second drum section may be passed into this second drum section from the silo 25 by means of the conveyor 26, via the material intake 24 and/or through the supply tube 58. These further materials may be one or more of the following materials: Binders, such as bitumen, recycled materials in the form of broken, used asphalt pavement, filler, additives, etc. When the material portion in the first drum section has obtained the desired temperature and the desired degree of dryness, and when the materials in the second drum section have been suitably mixed, the inlet end of the drum is again lifted by means of the cylinder 16, and the end wall 50 of the drum 10 is opened so that the finished mixed material portion may be either poured into the supply end of the conveyor 27 and be passed into the product silo 28 or — if the mixture is to have further substances added to it — poured into the supply end of the conveyor 29 and be passed into the buffer silo 41. From the silo 41 the mixture is passed into the mixing apparatus 30 in metered amounts together with metered amounts of the further desired additives, such as colouring agents, certain chemicals, etc. When the mixture has been poured out of the second drum section of the drum 10, the end wall 50 of the drum is again closed, and the annular partition wall 47, if any, is opened so that the heated and dried material portion from the first drum section may slide into the second drum section. After closure of the partition wall 47, a new portion of raw materials may be passed into the first drum section from the silos 18, whereupon the inlet end of the drum may again be lowered, and the process described above may be repeated. To ensure that a good mixture of the material components is obtained in the mixing apparatus 30 without the mixing time being made longer than necessary, measuring probes may be arranged at different locations in the mixing apparatus, which probes measure the percentage content of one of the material components added. When the various measuring probes ascertain the presence of substantially the same relative amount of the material component in question, the mixing process may be interrupted, and the mixed material may be emptied into the inlet 42 of the conveyor 43 which may pass the finished portion of asphalt mixture into a product silo for finished product, not shown.

It is understood that the drum 10 may be divided into more than two drum sections so that more than two material portions of different compositions may be treated simultaneously in the drum. Different material components may then be added and mixed in for example the second and the third drum sections. Alternatively, the plant may be operated in such a manner in batch-mixing that only one material portion is present in the drum 10 at a time, this material portion, after heating and drying in the first drum section, being poured directly into the inlet end of the conveyor 29 and passed from there via the buffer silo 41 to the mixing apparatus 30. Both bitumen and filler and any additives may then be mixed together with the heated and dried sand and stone materials in the mixing apparatus 30.

The electronic control device or microcomputer 39 indicated in FIG. 3 may control and monitor the operation of the whole plant. Thus a very large number of recipes for different types of paving or asphalt mixtures may be stored in the memory of the microcomputer. Based on these recipes the microcomputer may control the metering of sand and stone material from the silos 18 which is passed to the inlet end of the drum 10, the metering of bitumen, filler, pigment, latex and/or other additives via the intake 24 and/or the supply tube 58. Because the flow rates of the various materials through the system are different, the computer may also control the timing of releasing and supplying the various materials to be mixed so that they arrive at their final destination, i.e. the final mixing zone in the system at substantially the same time. This means that the desired composition of the mixture produced is obtained even for the first and last part of a large batch or amount of bituminous mixture being produced. Furthermore, the computer may control one or more of the following operations: The addition of further additives to the mixing apparatus 30, rotation and tilting of the drum 10, the function of the filter 33, recycling of material filtered off to the drum 10 or the mixing apparatus 30, adjustment of the burner 17, adjustment of supply of air and fuel to the burner 17, supply of surplus combustion air to the burner 17 based on measurement of CO or $O_2$ present in the combustion gas, the temperature of combustion gas within the drum 10, opening and closing operations of the partition wall 47 and the end closure or end wall 50. The computer 39 may further be adjusted to monitor a correct function of the various units and to give the alarm in the case of a malfunction.

The control device or the microcomputer 39 may further control the location of the supply tube(s) 58 and the time for the supply of metered amounts of bitumen, filler, flux agents and other additives in the case of batch-mixing. This control of the location and time may, for example, be made by means of equipment comprising one or more of the following devices:

(a) a microphone arranged at or inside the supply tube or tubes to register noise from stone materials falling down on the outer surface of the tube.

(b) strain gauges arranged on the supply pipe or pipes for measuring bending stresses when the pipe or pipes are hit by stone materials.

(c) a rebound plate associated with an electrically or pneumatically operating pulse system, by means of which pulses are counted or a continuous signal is given when the rebound plate is hit by stone materials.

It should be understood that various amendments and modifications of the embodiment described above and shown in the drawings could be made within the scope of the present invention as defined in the following claims.

I claim:

1. A drying and mixing plant for the production of a bituminous paving mixture, said plant comprising a drying and mixing drum (10) having inlet and outlet ends, driving means (11, 12) for rotating the drum about its longitudinal axis, means (21–23) for feeding aggregate material into the drum at its inlet end, and means (24–26) for supplying a further component material, such as a binder, into the drum at locations intermediate of the inlet and outlet ends, characterized by inclination adjustment means (16) for lifting and lowering the drum (10) so as to change the inclination of the drum axis, closure means (50, FIG. 3) for selectively at least partly closing and opening the outlet end of the drum (10), said drum (10) being divided into sections by at least one annular partition wall (47) extending radially inward from the inner wall of the drum, said partition wall being selectively movable between a position in which flow of material between adjacent drum sections is obstructed and a position in which material may flow freely from one section to another.

2. A plant according to claim 1, further including heating means comprising at least one burner (17) directed into the drum, characterized in that the burner (17) is mounted in such a manner that its direction in relation to the drum axis may be altered.

3. A plant according to claim 1, characterized in that the annular partition wall (47) is divided into ring sectors (48) of which at least some are movable between an obstructing position in which they extend transversely to the drum axis, and a non-obstructing position in which they extend substantially parallelly with or define an acute angle with the drum axis.

4. A plant according to any of the claims 1, characterized in that the means for supplying a further component comprises a peripherally extending baffle wall (54) projecting radially inward from the inner wall of the drum (10) and defining an introduction chamber opening towards the outlet end of the drum, the baffle wall being divided into sectors so as to define peripheral gaps (56) between adjacent sectors.

5. A plant according to claim 1, characterized in further comprising a mixing apparatus (30) communicating with the outlet end of the drum by means of a conveyor (29).

6. A plant according to any of the claims 1, characterized in comprising an electronic control device (39) being adapted for comparing sensed or measured values against values, such as recipes, stored in the electronic control's memory and in dependence of the comparison controlling and monitoring the operation of the whole plant.

7. A plant according to any of the claims 1, characterized in that at the outlet end of the drum (10) an end wall (50, FIG. 4) or a closure may be arranged which may be moved in relation to the drum between a closed position in which the outlet end of the drum is wholly or partially closed, and an open position in which the outlet end is open.

* * * * *

UNITED STATES PATENT AND TRADEMARK OFFICE

CERTIFICATE OF CORRECTION

PATENT NO. : 5,190,371

DATED : March 2, 1993

INVENTOR(S) : Jorgen Gjerulff

It is certified that error appears in the above-indentified patent and that said Letters Patent is hereby corrected as shown below:

Claim 4, column 12, line 42, change "any of the claims" to --claim--.

Claim 6, column 12, line 54, change "any of the claims" to --claim--.

Signed and Sealed this

Twenty-fourth Day of January, 1995

*Attest:*

*Attesting Officer*

Bruce Lehman

BRUCE LEHMAN

*Commissioner of Patents and Trademarks*

UNITED STATES PATENT AND TRADEMARK OFFICE

CERTIFICATE OF CORRECTION

PATENT NO. : 5,190,371
DATED : March 2, 1993
INVENTOR(S) : Jorgen Gjerulff

It is certified that error appears in the above-indentified patent and that said Letters Patent is hereby corrected as shown below:

Item [73],

Title page, Assignee, should be changed from "Pedershaab Maskinfabrik A/S" to --

--Pedershaab A/S--.

Signed and Sealed this

Thirtieth Day of July, 1996

Bruce Lehman

*Attest:*

BRUCE LEHMAN

*Attesting Officer*

*Commissioner of Patents and Trademarks*